US008537088B2

(12) United States Patent
Xiao et al.

(10) Patent No.: US 8,537,088 B2
(45) Date of Patent: Sep. 17, 2013

(54) SOURCE DRIVE CHIP OF LIQUID CRYSTAL DISPLAY

(75) Inventors: Xiangchun Xiao, Beijing (CN); Xinshe Yin, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 422 days.

(21) Appl. No.: 12/729,707

(22) Filed: Mar. 23, 2010

(65) Prior Publication Data

US 2010/0245325 A1 Sep. 30, 2010

(30) Foreign Application Priority Data

Mar. 27, 2009 (CN) ..... 2009 1 0081008

(51) Int. Cl.
*G09G 3/36* (2006.01)

(52) U.S. Cl.
USPC ..... 345/89; 345/98

(58) Field of Classification Search
USPC ..... 345/89, 690, 98
See application file for complete search history.

(56) References Cited

U.S. PATENT DOCUMENTS

| | | | | |
|---|---|---|---|---|
| 2002/0033786 | A1* | 3/2002 | Akimoto et al. | 345/87 |
| 2002/0044142 | A1* | 4/2002 | Fukuda | 345/204 |
| 2002/0093992 | A1* | 7/2002 | Plangger | 370/535 |
| 2004/0153795 | A1* | 8/2004 | Teraishi | 714/27 |
| 2005/0122300 | A1* | 6/2005 | Makuuchi et al. | 345/95 |
| 2005/0162374 | A1* | 7/2005 | Kim et al. | 345/100 |
| 2005/0174316 | A1* | 8/2005 | Kang | 345/100 |
| 2005/0195149 | A1 | 9/2005 | Ito | |
| 2006/0208795 | A1 | 9/2006 | Mizutani et al. | |
| 2006/0274020 | A1* | 12/2006 | Sung et al. | 345/100 |
| 2007/0018939 | A1 | 1/2007 | Chen et al. | |
| 2007/0195052 | A1* | 8/2007 | Oh et al. | 345/100 |
| 2007/0216633 | A1 | 9/2007 | Kim | |
| 2007/0290983 | A1 | 12/2007 | Kim et al. | |
| 2008/0265930 | A1* | 10/2008 | Teraishi | 324/763 |
| 2009/0146985 | A1* | 6/2009 | Okada et al. | 345/211 |
| 2009/0262146 | A1* | 10/2009 | Hashimoto | 345/690 |

FOREIGN PATENT DOCUMENTS

| | | | |
|---|---|---|---|
| CN | 1664739 | A | 9/2005 |
| CN | 1928635 | A | 3/2007 |
| JP | 2002-314421 | A | 10/2002 |
| JP | 2008-032919 | A | 2/2008 |
| KR | 20020020419 | A | 3/2002 |

(Continued)

OTHER PUBLICATIONS

KIPO Notice of Allowance dated Aug. 20, 2012; Appln. No. KR1020100027502.

*Primary Examiner* — Adam J Snyder
(74) *Attorney, Agent, or Firm* — Ladas & Parry LLP

(57) ABSTRACT

The present disclosure discloses a source driver chip comprising a reference voltage input terminal and a data signal output channel in which an operational amplifier for outputting a data signal is disposed. When at least one of the operational amplifiers is in idle instead of being used for outputting the data signal, the operational amplifier in idle is connected to the reference voltage input terminal and used to amplify a reference voltage inputted to the reference voltage input terminal; or the operational amplifier in idle is connected to an external circuit and used to amplify an external circuit signal other than the reference voltage. The present disclosure can save the operational amplifiers in the peripheral driving circuit, and reduce the cost of the peripheral driving circuit as well as the power consumption.

9 Claims, 4 Drawing Sheets

(56) References Cited

FOREIGN PATENT DOCUMENTS

| | | | |
|---|---|---|---|
| KR | 20060101161 | A | 9/2006 |
| KR | 20070012176 | A | 1/2007 |
| KR | 20070120221 | A | 12/2007 |
| WO | 02/21499 | A1 | 3/2002 |

* cited by examiner

SOURCE DRIVE CHIP OF LIQUID CRYSTAL DISPLAY

BACKGROUND

The present disclosure is related to a driving technology for liquid crystal display, in particular, related to a source driver chip.

A driving circuit is an important portion in the industry link of liquid crystal display. The driving circuit, which is a critical device for the Thin Film Transistor-Liquid Crystal Display (hereinafter, TFT-LCD for short) module, takes a responsibility for turning on the thin film transistor and controlling the change in the arrangement of liquid crystal molecules. In the field of TFT-LCD driver, there still exist some problems to be improved, for example, the source driver chip of TFT-LCD has the technical defects as follows.

On the one hand, at data signal output terminal, the number of data signal output channel which can be maximally provided by the source driver chip is of a certainty, such as 720 channels, while the number of one row of sub-pixels in the display area of liquid crystal display is not always an integer times of the number of data signal output channels which can be maximally provided. Therefore, the data signal output channels in some source driver chips are in idle without being utilized. Moreover, an operational amplifier is disposed as a buffer in the data signal output channel. When the data signal output channel is normally utilized, the operational amplifier can be used to output the data signal normally, and when the data signal output channel is in idle, the operational amplifier is also left idle instead of being utilized, thus resulting in a waste of the operational amplifier in idle data signal output channel.

On the other hand, at input terminal of a reference voltage signal such as Gamma voltage, while two redundant operational amplifiers which can be used for the drive of the reference voltage, are incorporated into the source driver chip in the prior art, the connection has to be made through the external circuit, which increases the number of the external wires and is relatively complicated. Therefore, the amount of the redundant operational amplifiers is limited, and the resources in the internal space of the source driver chip can not be sufficiently utilized. In addition, since the extremely small resistors connected in parallel are required for the reference voltage circuit of peripheral driving circuit so as to decrease the influence on reference voltage by the internal Gamma resistors of source driver chip, this results in an increment in power consumption of the peripheral driving circuit.

SUMMARY

A object of the present disclosure is to provide a source driver chip, which can sufficiently make use of the operational amplifier in idle data signal output channel and avoid a waste of the idle operational amplifier, and can save the cost of the peripheral driving circuit and reduce the power consumption in peripheral driving circuit.

The present disclosure provides a source driver chip comprising a reference voltage input terminal and a data signal output channel in which an operational amplifier for outputting a data signal is disposed; when at least one of the operational amplifiers is in idle instead of being used for outputting the data signal, the operational amplifier in idle is connected to the reference voltage input terminal and used to amplify a reference voltage inputted to the reference voltage input terminal; or the operational amplifier in idle is connected to an external circuit and used to amplify an external circuit signal other than the reference voltage.

Based on the technical solution described above, an input terminal of the operational amplifier in idle is connected to an input selection controller, and an output terminal of the operational amplifier in idle is connected to an output selection controller; the input selection controller and the output selection controller are used to control the operational amplifier to amplify the external circuit signal or a normally outputted data signal, the external circuit signal including a reference voltage or an external circuit signal other than the reference voltage. Each of the input selection controller and the output selection controller is a CMOS selection control circuit. A signal selection control line is further included, which is respectively connected to the input selection controller and the output selection controller and used to control the input selection controller and the output selection controller to select the normally outputted data signal or the amplification on external circuit signal by the operational amplifier.

In addition, the operational amplifier includes a first input terminal and a second input terminal as well as a first output terminal and a second output terminal; the first input terminal and the first output terminal are used to connect the operational amplifier to a data signal channel in which the data signal is normally outputted, the second input terminal and the second output terminal are used to connect the operational amplifier to an external circuit signal channel in which amplification is performed on the external circuit signal, the external circuit signal including a reference voltage or an external circuit signal other than the reference voltage; when the operational amplifier in idle exists in each of the source driver chips of the liquid crystal display, the data signal channel is disconnected by the integrated circuit blowing technology and a program manner of blowing a programmer or by a partial programmable logic circuit inside the source driver chip in a program manner; the operational amplifier is connected to the external circuit signal channel through the second input terminal and the second output terminal, and used to amplify the external circuit signal.

According to the source driver chip of the present disclosure, by utilizing an operational amplifier in the idle data signal output channel to amplify a reference voltage and/or an external circuit signal other than the reference voltage, the waste of the operational amplifier in the idle data signal output channel can be avoided, also the operational amplifiers in the peripheral driving circuit can be saved and the cost as well as the power consumption of the peripheral driving circuit can be reduced.

DETAILED DESCRIPTION OF THE EMBODIMENTS

The main design concept of the present disclosure is that, when an operational amplifier in the data signal output channel of the source driver chip is in idle instead of being utilized, a part of the operational amplifiers in idle are connected to a reference voltage input terminal of the source driver chip and used to amplify a reference voltage inputted to the reference voltage input terminal; or the idle operational amplifiers are connected to an external circuit and used to amplify an external circuit signal other than the reference voltage. In this way, on the one hand, a waste of the operational amplifier in the idle data signal output channel can be avoided; on the other hand, the operational amplifiers in the external driving circuit can be saved, thus the cost and the power consumption of the external driving circuit can be reduced.

Hereinafter, the technical solution of the present disclosure will be further described in details with reference to the drawings and embodiments.

Figure 1:
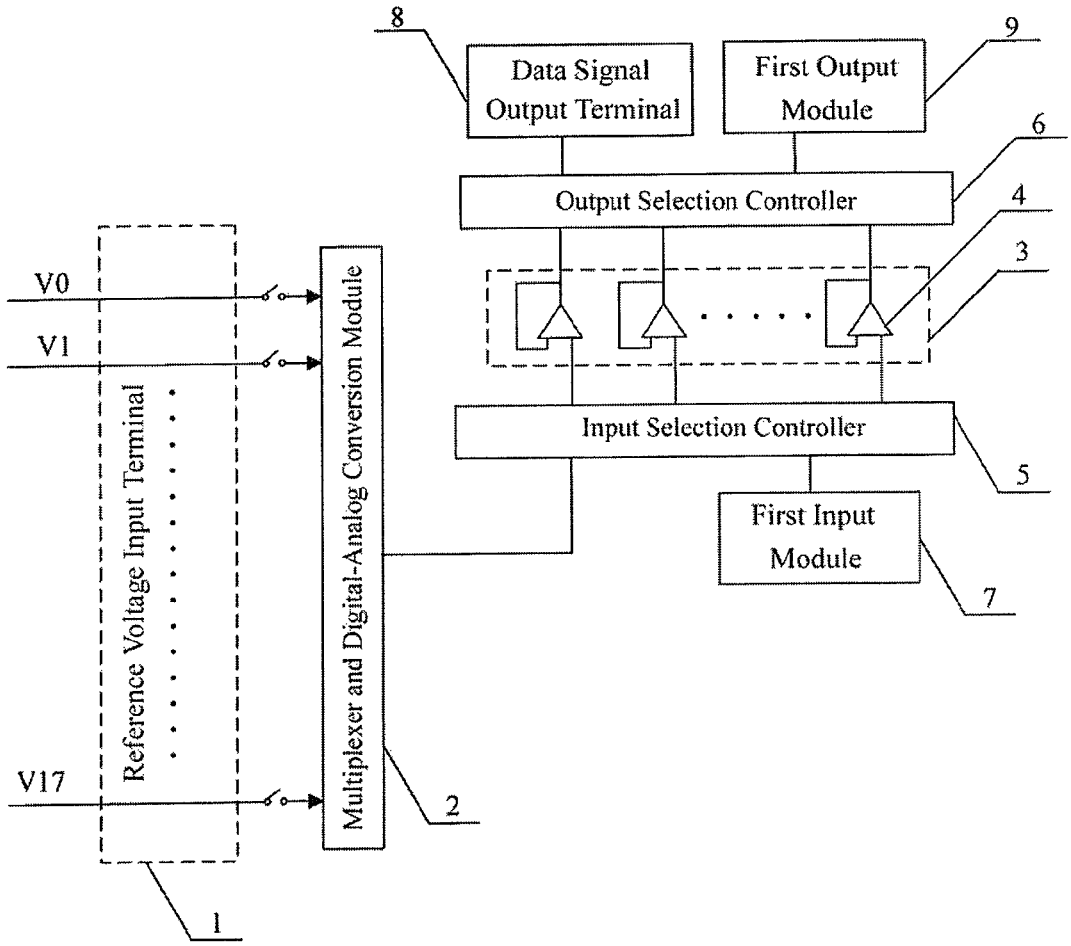
FIG. 1 is a structural schematic diagram for a source driver chip according to the first embodiment of the present disclosure.

FIG. 1 is a structural schematic diagram for a source driver chip according to the first embodiment of the present disclosure. As shown in FIG. 1, in the embodiment, the source driver chip includes a reference voltage input terminal 1, a multiplexer and digital-to-analog conversion module 2 and a data signal output channel group 3. Among them, the reference voltage input terminal 1, which is connected to the multiplexer and digital-to-analog conversion module 2 via a switch, inputs the received reference voltage inputted to the source driver chip, such as V0 to V17 shown in FIG. 1, to the multiplexer and digital-to-analog conversion module 2. Wherein, the reference voltages of V0 to V17 inputted to the reference voltage input terminal 1 are generated from the power supply divided by the resistors in series. The multiplexer and digital-to-analog conversion module 2 is connected to the data signal output channel group 3. In the present embodiment, it can be assumed that the data signal output channel group 3 includes 720 data signal output channels, and a first operational amplifier 4 is disposed in each of the data signal output channels.

In the present embodiment, when the operational amplifier in the data signal output channel is in idle, it can be used to amplify a reference voltage or another external circuit signal, and the detailed selection control manner for the channel is shown in FIG. 1. The design concept of the present embodiment is that, an input selection controller 5 and an output selection controller 6 can be respectively added to the input and output terminals of the data signal output channel group 3, so that the input terminal of the first operational amplifier 4 in the data signal output channel is connected to the input selection controller 5 and the output terminal thereof is connected to the output selection controller 6. It needs to be explained herein that, it is possible for the input and output terminals of all the idle operational amplifiers to be connected to the input selection controller 5 and the output selection controller 6, and it is also possible for the input and output terminals of only a part of the idle operational amplifiers to be connected to the input selection controller 5 and the output selection controller 6. The input selection controller 5 is connected to the multiplexer and digital-to-analog conversion module 2 and a first input module 7, and the output selection controller 6 is connected to a data signal output terminal 8 and a first output module 9. In this way, the input selection controller 5 and the output selection controller 6 can control the data signal output channel in the data signal output channel group 3. When the data signal output channel is normally used, the first operational amplifier 4 in the channel can be used to output the data signal normally. At this moment, the input selection controller 5 controls the input terminal of the first operational amplifier 4 in the data signal output channel to be connected to the multiplexer and digital-to-analog conversion module 2, the output selection controller 6 controls the output terminal of the first operational amplifier 4 in the data signal output channel to be connected to the data signal output terminal 8, and the first operational amplifier 4 functions as a buffer for normally outputting the data signal. When the switch between the reference voltage input terminal 1 and the multiplexer and digital-to-analog conversion module 2 is switched on, the reference voltages of V0~V17 are inputted from the reference voltage input terminal 1 to the multiplexer and digital-to-analog conversion module 2, then put into the data signal output channel group 3 and subjected to the amplification by the first operational amplifier 4, and then outputted from the data signal output terminal 8. When the data signal output channel is in idle, the first operational amplifier 4 in the channel can be used to amplify the other input signals. That is, the input selection controller 5 controls the input terminal of the first operational amplifier 4 in the data signal output channel to be connected to the first input module 7, the output selection controller 6 controls the output terminal of the first operational amplifier 4 in the data signal output channel to be connected to the first output module 9, and the first operational amplifier 4 is used to amplify the other input signals. The input selection controller and the output selection controller described above can be a selection control circuit made of Complementary Metal-Oxide Semiconductor (hereinafter, CMOS for short). When the other input signal described above, which can be a reference voltage signal or another external circuit signal, is the reference voltage signal, the first input module 7 and the first output module 9 can be a reference voltage input module and a reference voltage output module respectively. That is, it is equivalent to that the first operational amplifier 4 in idle is connected to the reference voltage input terminal of the source driver chip and performs amplification on a reference voltage inputted to the reference voltage input terminal. At this moment, the reference voltage input terminal 1 is also connected to the first input module 7, and the reference voltage is not directly put into the multiplexer and digital-to-analog conversion module 2; instead, the switch between the reference voltage input terminal 1 and the multiplexer and digital-to-analog conversion module 2 is disconnected, and after inputted from reference voltage input terminal 1, the reference voltage is directly put into the first input module 7 connected thereto, then put into the data signal output channel group 3 and amplified by the first operational amplifier 4. This is equivalent to that the operational amplifier in the original external reference voltage generation circuit is replaced by the first operational amplifier 4. The amplified reference voltage is outputted from the first output module 9, and then put into the multiplexer and digital-to-analog conversion module 2. The other input signal described above also can be another external circuit signal other than the reference voltage. At this moment, the first input module 7 and the first output module 9 also can be another external circuit signal input module and another external circuit signal output module. That is, it is equivalent to that the idle operational amplifier 4 is connected to the external circuit and performs amplification on another external circuit signal. At this moment, the other external circuit signals other than the reference voltage are inputted from the outside of source driver chip to the first input module 7 directly, amplified by the first operational amplifier 4, and then outputted from the first output module 9 to the external circuit.

Using an operational amplifier in the idle data signal output channel to amplify a reference voltage inputted from the reference voltage input terminal or the another external circuit signal inputted from the external circuit, the source driver chip of the present embodiment can eliminate the operational amplifier in the peripheral driving circuit, thus the cost and the power consumption in the peripheral driving circuit can be reduced.

Figure 2:
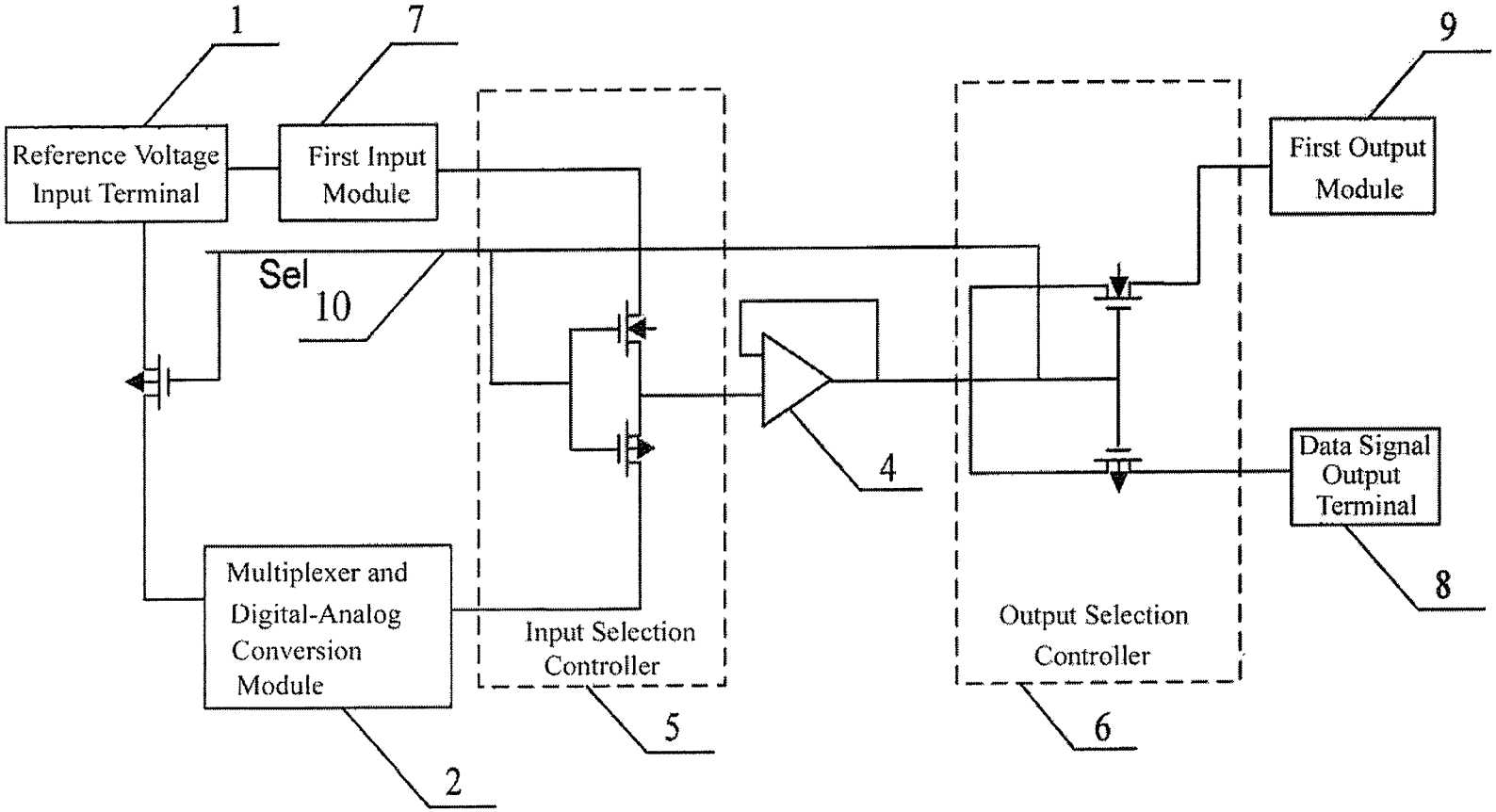
FIG. 2 is a structural schematic diagram for a source driver chip according to the second embodiment of the present disclosure.

FIG. 2 is a structural schematic diagram for a source driver chip according to the second embodiment of the present disclosure. As show in FIG. 2, one terminal of the reference voltage input terminal 1 is connected to the first input module 7, and the other terminal thereof is connected to the multiplexer and digital-to-analog conversion module 2. The switch in the embodiment can be a CMOS selection switch. The first input module 7 is connected to the first operational amplifier 4 in the data signal output channel via a selection switch in the input selection controller 5, and the multiplexer and digital-to-analog conversion module 2 is connected to the first operational amplifier 4 in the data signal output channel via a selection switch with reversed phase in the input selection controller 5, which is the same as the selection switch used for connecting the reference voltage input terminal 1 to the multiplexer and digital-to-analog conversion module 2. In the output selection controller 6, the first output module 9 and the data signal output terminal 8 are respectively connected to the first operational amplifier 4 via two selection switches with reversed phase. A selection control signal line 10 is connected to the input selection controller 5 and the output selection controller 6 respectively, and used to control the selection switch to be turned on and off.

The operation procedure of the selection control circuit to control the operational amplifier in the idle data signal output channel to amplify a reference voltage is as follows. If the data signal output channel is utilized while the source driver chip is in operation, the selection control signal line 10 outputs a low level, and the selection switch connected to the multiplexer and digital-to-analog conversion module 2 in the input selection controller 5 and the selection switch which connects the reference voltage input terminal 1 to the multiplexer and digital-to-analog conversion module 2 are turned on; the selection switch connected to the data signal output terminal 8 in the output selection controller 6 is turned on; the input and output terminals of the first operational amplifier 4 in the data signal output channel are respectively connected to the multiplexer and digital-to-analog conversion module 2 and the data signal output terminal 8; the first operational amplifier 4 functions as a buffer for data signal output, and the data signal output channel is used to output a normally displayed signal. If the data signal output channel is left idle instead of being used, the selection control signal line 10 outputs a high level, and the selection switch connected to the first input module 7 in the input selection controller 5 is turned on; the switch between the reference voltage input terminal 1 and the multiplexer and digital-to-analog conversion module 2 is switched off; the selection switch connected to the first output module 9 in the output selection controller 6 is turned on; the input and the output terminals of the first operational amplifier 4 in the data signal output channel are respectively connected to the first input module 7 and the first output module 9. The reference voltage is directly inputted from the reference voltage input terminal 1 to the first input module 7, and after amplified by the first operational amplifier 4, the reference voltage is outputted from the first output module 9, and then put into the multiplexer and digital-to-analog conversion module 2 from the first output module 9. In the present embodiment, it is the reference voltage signal that is inputted to the first input module 7, and it is also the reference voltage that is outputted from the first output module 9; the first operational amplifier 4 functions as a buffer for reference voltage output, and the data signal output channel is no longer used for outputting a normal data signal, but serves as the amplifier for reference voltage signal. This is equivalent to that the function of operational amplifier in the original external reference voltage generation circuit is replaced by the first operational amplifier 4.

For example, in order to apply the source driver chip of the present embodiment to the liquid crystal display whose display pixel is 1280×1024, six source driver chips are required, and each of the source driver chips includes 720 data signal output channels, wherein the number of the idle data signal output channels is (720×6−1280×3)=480. In this way, with the structure of present embodiment, the first operational amplifier 4 in the idle data signal output channel is utilized. Since the first operational amplifier 4 serves as an operational amplifier for reference voltage signal at this moment, the operational amplifier in the reference voltage generation circuit of the peripheral driving circuit can be eliminated. Thus, the cost of the peripheral driving circuit can be reduced. Moreover, since the reference voltage signal subjected to the amplification will make the output voltage more stable, display quality for the liquid crystal display also can be improved.

In the present embodiment, when the first operational amplifier 4 in the idle data signal output channel is used to amplify the reference voltage inputted to the source driver chip, it is possible to amplify a part or all of the inputted reference voltages. When a part of the inputted reference voltages are amplified, for example, it is possible to amplify the reference voltages of V3, V7, V10 and V14 inputted to the reference voltage input terminal 1 respectively. In a detailed embodiment, it is also possible to arbitrarily select 4 reference voltages to be amplified, or it is possible to amplify a different number of reference voltages among the reference voltages inputted to the reference voltage input terminal 1, which can be any 5, 6 and 7 and the like. With the means described in the above embodiment, after the operational amplifier in the idle data signal output channel is used to amplify the reference voltage inputted to the reference voltage input terminal, the function of the operational amplifier in reference voltage circuit which currently locates in the peripheral driving circuit can be replaced, and the operational amplifier for reference voltage amplification can be no longer disposed in the peripheral driving circuit. In this way, the cost of the peripheral driving circuit can be reduced. Moreover, with the means described in the present embodiment, no increment in wires will be resulted in, and the number of the operational amplifiers can be arbitrarily increased.

In addition, it is also possible for each of the reference voltages of V0 to V17 inputted to the reference voltage input terminal 1 to be amplified by the first operational amplifier 4. When all of the reference voltages are amplified, the present embodiment is equivalent to that 18 first operational amplifiers 4 are displaced in the reference voltage input terminal 1, and after amplified by the first operational amplifier 4, each of V0 to V17 is then inputted to the multiplexer and digital-to-analog conversion module 2. With all of the inputted reference voltages amplified by the displaced idle operational amplifier, it is possible to neglect the parallel connection between the voltage division resistors for producing the reference voltage in the reference voltage circuit of the peripheral driving circuit and the internal resistors of the source driver circuit. At this moment, in the reference voltage circuit of the peripheral driving circuit, large resistors in series can be selectively employed to divide the power supply. In the actual experiment, the power consumption can be reduced by 100 mW.

In the source driver chip of the present embodiment, by disposing the input control circuit and the output control circuit at the input and output terminals of the operational amplifier in the idle data signal output channel, performing switch control with a selection control signal, and using the operational amplifier in the idle data signal output channel to amplify the reference voltage inputted to the reference voltage input terminal, the operational amplifier in the peripheral driving circuit can be eliminated. Thus, the cost and the power consumption of the peripheral driving circuit can be reduced, and the display effect for the liquid crystal display also can be improved.

Figure 3:
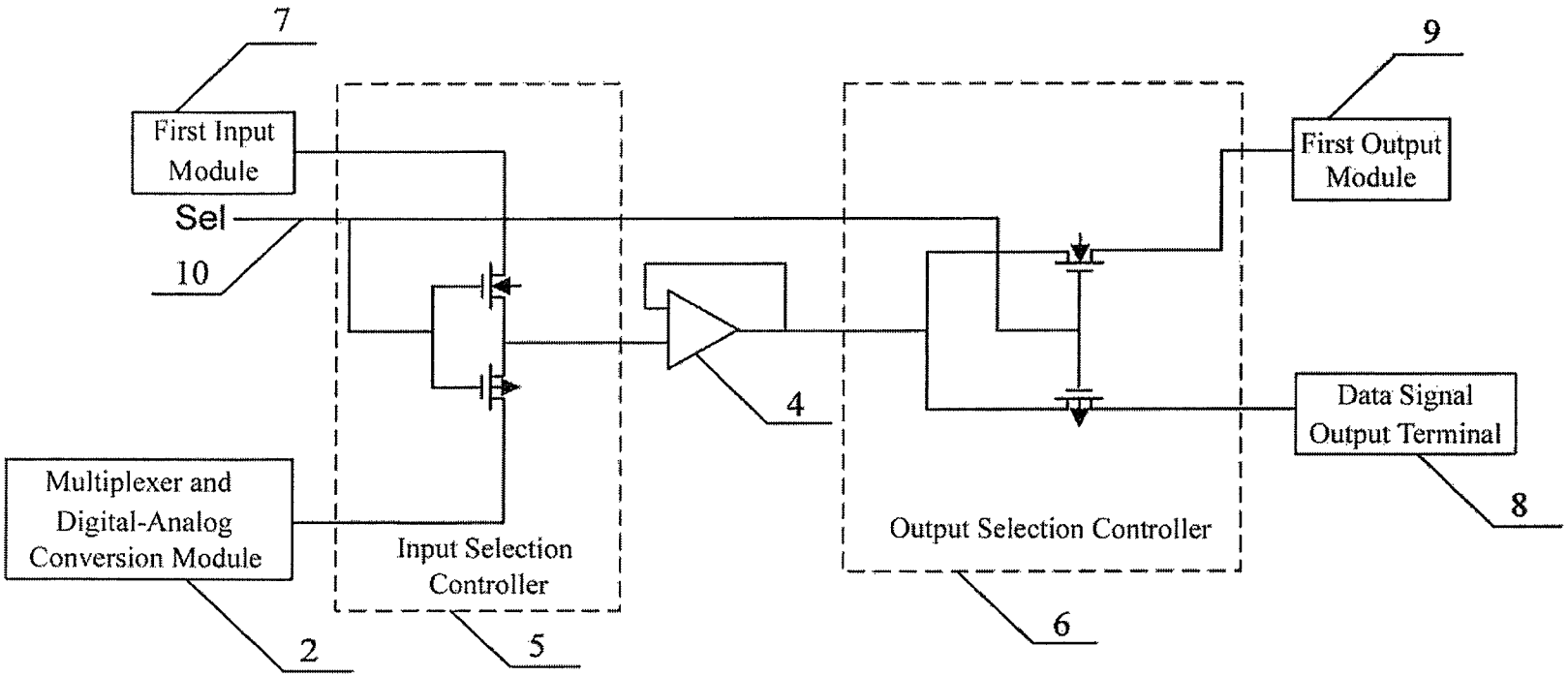
FIG. 3 is a structural schematic diagram for a source driver chip according to the third embodiment of the present disclosure.

FIG. 3 is a structural schematic diagram for a source driver chip according to the third embodiment of the present disclosure. The main difference between the third embodiment and the second embodiment is that, in the second embodiment, the operational amplifier in the idle data signal output channel is used as a reference voltage amplifier, while in the third embodiment, the operational amplifier in the idle data signal output channel is used as a amplifier for other external circuit signals other than the reference voltage.

As shown in FIG. 3, in the present embodiment, the first input module 7 and the first output module 9 are used for the input and output of other external circuit signals other than the reference voltage, and at this moment, each of the first input module 7 and the first output module 9 is connected to a peripheral driving circuit board. The operation procedure of the selection control circuit is as follow. If the data signal output channel is used while the source driver chip is in operation, the selection control signal line 10 outputs a low level, and as described in the second embodiment, the relevant selection switches are turned on; the input and output terminals of the first operational amplifier 4 in the data signal output channel are respectively connected to the multiplexer and digital-to-analog conversion module 2 and the data signal output terminal 8; the first operational amplifier 4 functions as a buffer for data signal output, and the data signal output channel is used for outputting the normally displayed signal. If the data signal output channel is left idle instead of being used, a selection control signal line 10 outputs a high level, and the relevant selection switches are turned on; the input and output terminals of the first operational amplifier 4 in the data signal output channel are respectively connected to the first input module 7 and the first output module 9. At this moment, the first input module 7 is connected to the external circuit, and the external circuit signal is directly inputted to the first input module 7, subjected to amplification by the first operational amplifier 4, and outputted from the first output module 9 to the external circuit. The first operational amplifier 4 serves as a general voltage-follower amplifier, and the data signal output channel is no longer used for outputting the normally displayed signal. In this way, the application of the operational amplifier in the idle data signal output channel can be arranged in accordance with the detailed requirements for the driving circuit.

Based on the second embodiment and the third embodiment described above, it is also possible to combine these two embodiments with each other. That is, the idle data signal output channels are divided into two parts, in which the operational amplifiers in one part of the data signal output channels are selectively used between a case of being used for normally outputting the data signal and a case of being used as a reference voltage amplifier, and the operational amplifiers in the other part of the idle data signal output channels are selectively used between a case of being used for normally outputting the data signal and a case of being used as an amplifier for other external circuit signals used with external connection other than the reference voltage. At this moment, the selection control signal line 10 is also divided into two branches which respectively are a first selection control signal line and a second selection control signal line. Wherein, the first selection control signal line is used to control the input selection controller 5 and the output selection controller 6 to switch between a case of normally outputting the data signal and a case of being used as a reference voltage amplifier, and the second selection control signal line is used to control the input selection controller 5 and the output selection controller 6 to switch between a case of normally outputting the data signal and a case of being used with external connection. The detailed implementing procedure for the selection control can refer to the description for the second embodiment and the third embodiment, and the redundant description is omitted herein. In this way, the application of the operational amplifier in the idle data signal output channel can be arranged in accordance with the detailed requirements for the driving circuit.

Figure 4:
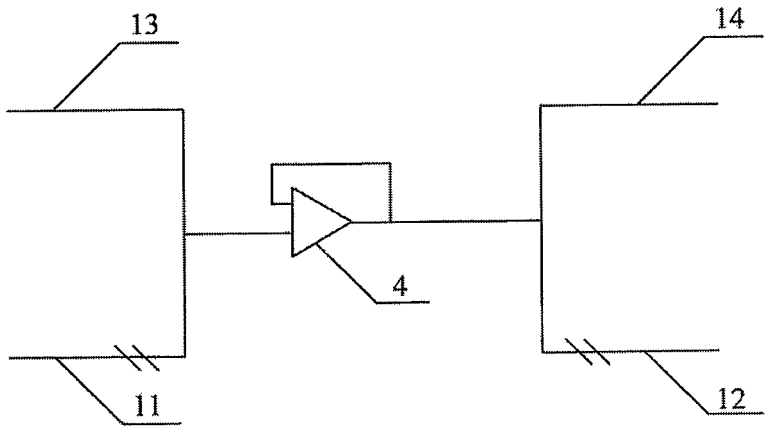
FIG. 4 is a structural schematic diagram for a source driver chip according to the fourth embodiment of the present disclosure.

FIG. 4 is a structural schematic diagram for a source driver chip according to the fourth embodiment of the present disclosure. As shown in FIG. 4, the main difference between the fourth embodiment and the first to the third embodiments is that, in the source driver chip of the first to the third embodiments described above, the idle operational amplifier changes the input and output states of the operational amplifier by adding the input selection controller and the output selection controller to the input and output terminals of the operational amplifier; while in the source driver chip of the present embodiment, the change in the input and output states of the idle operational amplifier is realized by programming.

The structure of the source driver chip in the first to the third embodiments described above is more suitable for the case in which the utilization of the output channels of source driver chip are not totally identical. That is, in the process of actual manufacture, on the same liquid crystal display module, a case may be encountered in which all of the data signal output channels, on a part of source driver chips, are being utilized while not all of the data signal output channels, on other parts of source driver chips, are being utilized. At this moment, with the structure of the source driver chip described in the above embodiments, it is possible to take advantage of the operational amplifier in the idle data signal output channel of a source driver chip by controlling the output mode of each of source driver chips with the input selection controller and the output selection controller.

However, when none of the source driver chips for the liquid crystal display is designed to employ all of the channels, that is, when each of the source driver chips includes the idle operational amplifiers, the structure of the source driver chip of the present embodiment is more suitable to be employed. Particularly, the operational amplifier 4 of the present embodiment comprises a first input terminal 11 and a first output terminal 12 for connecting the operational amplifier to the data signal channel in which the data signal is normally outputted, and a second input terminal 13 and a second output terminal 14 for connecting the operational amplifier to the external circuit signal channel in which the amplification is performed on the external circuit signal. The external circuit signal comprises a reference voltage or external circuit signals other than the reference voltage. At this moment, the data signal channel can be disconnected by the integrated circuit blowing technology and program technology of blowing programmer, or by a partial programmable logic circuit inside the source driver chip in a program manner. That is, the connection between the first input terminal 11 as well as the second output terminal 12 and the data signal channel is disconnected, so that the operational amplifier is connected to the external circuit signal channel only by way of the second input terminal 13 and the second output terminal 14, for example, the operational amplifier is connected to the reference voltage input terminal of the source driver chip or the external circuit and used to amplify the external circuit signals. This is equivalent to that the operational amplifier in the data signal output channel is displaced to the reference voltage input terminal or is connected to the external circuit, and a source driver chip in which the output mode is less than 720 data signal output channels is obtained. The detailed implementing method can be as follows. In the last period of manufacture procedure for manufacture process of a source driver chip, selection for the data signal output channel is set and accomplished by a program manner of blowing programmer, then the connection wires to the selected data signal output channel are blown with the integrated circuit blowing technology; also, it is possible to change, through the partial programmable logic circuit inside the source driver chip, the strobe state of the data signal output channel in the source driver chip in a program manner, and to set and accomplish the selection for the data signal output channel in a program manner.

In the source driver chip of the present embodiment, an improvement is made to the data signal output terminal, in which the operational amplifier in the idle data signal output channel is utilized to amplify a reference voltage and/or other external signals; by disposing the input control circuit and the output control circuit at the input and output terminals of the operational amplifier in the idle data signal output channel as well as performing switch control with a selection control signal, the cost of the peripheral driving circuit can be saved, and the display effect for the liquid crystal display also can be improved.

Finally, it should be explained that the above embodiments are only for explaining the technical solution of the present disclosure, and not for limitation. Although the present disclosure has been described in details with reference to the embodiments, it should be appreciated by those skilled in the art that the technical solution of the present disclosure can be modified or equivalently replaced without departing from the spirit and scope of the technical solution in the present disclosure.

What is claimed is:

1. A source driver chip of a liquid crystal display comprising:

a multiplexer and digital-to-analog conversion module for inputting N data signals;

a first input module for inputting one or more external circuit signals;

an input selection controller connected to the multiplexer and digital-to-analog conversion module and the first input module;

a data signal output channel group connected to the input selection controller and in which M operational amplifiers being disposed, M being larger than or equal to N;

an output selection controller connected to the data signal output channel group;

a data signal output terminal connected to the output selection controller and used to output amplified data signals; and a first output module connected to the output selection controller and used to output amplified external circuit signals, wherein the input selection controller and the output selection controller are used to connect N operational amplifiers of the M operational amplifiers to the multiplexer and digital-to-analog conversion module so as to amplify the N data signals respectively, and connect at least one of remaining (M−N) operational amplifiers of the M operational amplifiers to the first input module so as to amplify at least one of the external circuit signals.

2. The source driver chip according to the claim 1, wherein, an input terminal of each operational amplifier of the M operational amplifiers is connected to the input selection controller, and an output terminal of the each operational amplifier of the M operational amplifiers is connected to the output selection controller, the input selection controller and the output selection controller are used to control the each operational amplifier to amplify the external circuit signals or the data signals, and the external circuit signals include reference voltages or external circuit signals other than the reference voltages.

3. The source driver chip according to the claim 2, wherein, the input selection controller and the output selection controller are CMOS selection control circuits.

4. The source driver chip according to the claim 3, wherein, further comprising a signal selection control line connected to the input selection controller and the output selection controller respectively, and used to control the input selection controller and the output selection controller to select amplification on the data signals or the external circuit signals by the operational amplifiers.

5. The source driver chip according to the claim 1, wherein the input terminals of a part of the M operational amplifiers are connected to the input selection controller, and the output terminals thereof are connected to the output selection controller, the input selection controller and the output selection controller are used to control the part of the M operational amplifiers to amplify reference voltages or the data signals; and the input terminals of another part of the M operational amplifiers are connected to the input selection controller, and the output terminals thereof are connected to the output selection controller, the input selection controller and the output selection controller are used to control the other part of the M operational amplifiers to amplify external circuit signals other than the reference voltages or the data signals.

6. The source driver chip according to the claim 5, wherein, the input selection controller and the output selection controller are CMOS selection control circuits.

7. The source driver chip according to the claim 6, wherein, further comprising a signal selection control line connected to the input selection controller and the output selection controller respectively, and used to control the input selection controller and the output selection controller to select amplification on the data signals or the external circuit signals by the operational amplifiers.

8. The source driver chip according to the claim 1, wherein, each operational amplifier of the M operational amplifiers includes a first input terminal and a second input terminal as well as a first output terminal and a second output terminal; the first input terminal and the first output terminal are used to connect the each operational amplifier to a data signal channel in which the data signals are normally outputted, the second input terminal and the second output terminal are used to connect the each operational amplifier to an external circuit signal channel in which amplification is performed on the external circuit signals, the external circuit signals including reference voltages or external circuit signals other than the reference voltages; when the remaining (M−N) operational amplifiers exists in each of the source driver chips for the liquid crystal display, the data signal channel is blown by the integrated circuit blowing technology and a program manner of blowing programmer; the at least one of the remaining (M−N) operational amplifiers is connected to the external circuit signal channel through the second input terminal and the second output terminal, and used to amplify the at least one of the external circuit signals.

9. The source driver chip according to the claim 1, wherein, each operational amplifier of the M operational amplifiers includes a first input terminal and a second input terminal as well as a first output terminal and a second output terminal; the first input terminal and the first output terminal are used to connect the each operational amplifier to a data signal channel in which the data signals are normally outputted, the second input terminal and the second output terminal are used to connect the each operational amplifier to an external circuit signal channel in which amplification is performed on the external circuit signals, the external circuit signals including reference voltages or external circuit signals other than the reference voltages; when the remaining (M−N) operational amplifiers exists in each of the source driver chips for the liquid crystal display, the data signal channel is disconnected in a program manner by a partial programmable logic circuit inside the source driver chip; the at least one of the remaining (M−N) operational amplifiers is connected to the external circuit signal channel through the second input terminal and the second output terminal, and used to amplify the at least one of the external circuit signals.

* * * * *